United States Patent [19]

Myers

[11] Patent Number: 4,990,102

[45] Date of Patent: Feb. 5, 1991

[54] ELECTRICAL CONNECTOR HAVING A SECONDARY CABLE STRAIN RELIEF AND A STRAIN RELIEF MEMBER THEREFOR

[75] Inventor: Ronald W. Myers, Landisburg, Pa.

[73] Assignee: AMP Incorporated, Harrisburg, Pa.

[21] Appl. No.: 386,845

[22] Filed: Jul. 28, 1989

[51] Int. Cl.[5] ..... H01R 13/58

[52] U.S. Cl. ..... 439/452; 439/470

[58] Field of Search ..... 439/344, 676, 449, 451–453, 439/459, 460, 463–473

[56] References Cited

U.S. PATENT DOCUMENTS

| | | | |
|---|---|---|---|
| 3,387,254 | 6/1968 | Wheeler | 439/470 |
| 4,127,315 | 11/1978 | McKee | 339/103 B |
| 4,127,316 | 11/1978 | McKee et al. | 339/103 R |
| 4,195,899 | 4/1980 | Radloff et al. | 339/103 M |
| 4,211,463 | 7/1980 | Chandler | 339/103 M |
| 4,214,803 | 6/1980 | McKee et al. | 339/103 R |
| 4,307,504 | 12/1981 | Davis et al. | 29/566.3 |
| 4,422,705 | 12/1983 | Kasper | 339/103 M |
| 4,432,592 | 2/1984 | Boutros et al. | 339/103 M |
| 4,557,545 | 12/1985 | Ohtsuki et al. | 439/470 |
| 4,652,072 | 3/1987 | Arasi, Jr. | 439/470 |
| 4,842,547 | 6/1989 | Defibaugh et al. | 439/460 |

*Primary Examiner*—David Pirlot
*Attorney, Agent, or Firm*—David L. Smith

[57] ABSTRACT

A strain relief member (22) adapted for securing a multi-conductor cable (28) to a connector (20) to provide strain relief to terminations of the conductors (26) of the multi-conductor cable (28) to respective contacts (24) in the connector (20) when the strain relief is secured to the connector. The strain relief member (22) has a U-shaped portion (34) having a bight (36) and two legs (38,40) extending therefrom. The legs (38,40) have securing means (44) thereon adapted to secure the strain relief member (22) to the connector (20). The bight (36) has a tab (58) extending therefrom having an insulation support ferrule (56) integral therewith. The ferrule (56) is adapted to be crimped about the cable (28) such that when the connector (20) is terminated to the cable (28) and the strain relief member (22) is secured to the connector (20) with the ferrule (56) crimped about the cable (28), forces transmitted along the cable (28) are transferred to the connector (20) through the strain relief member (22) and are thereby prevented from being transmitted to the conductor-to-contact terminations.

7 Claims, 5 Drawing Sheets

ELECTRICAL CONNECTOR HAVING A SECONDARY CABLE STRAIN RELIEF AND A STRAIN RELIEF MEMBER THEREFOR

BACKGROUND OF THE INVENTION

This invention relates to electrical connectors terminable to a cable and in particular to a secondary cable strain relief to prevent forces applied to the cable from being transmitted to the conductor-to-contact terminations. It is well known in the prior art to provide connectors terminable to a cable with structure to provide strain relief to conductor-to-cable terminations. The strain relief prevents forces applied to the cable from being transmitted to the conductor-to-contact terminations. The strain relief typically secures the cable to the housing in which the conductor-to-cable terminations are made such that any forces transmitted through the cable are then transferred to the connector housing rather than to the conductor terminations.

When a strain relief is designed into a connector, it is designed to withstand a predetermined force before failing. When the connector application subjects the strain relief to forces in excess of the design force, supplemental strain relief is necessitated.

SUMMARY OF THE INVENTION

In accordance with the invention, a strain relief member is adapted for securing a multi-conductor cable to a connector to provide strain relief to terminations of the conductors of the multi-conductor cable to respective contacts in the connector when the strain relief is secured to the connector. The strain relief member has a U-shaped portion having a bight and two legs extending therefrom. The legs have securing means thereon adapted to secure the strain relief member to the connector. The bight has a lateral extension extending therefrom having an insulation support ferrule integral therewith. The ferrule is adapted to be crimped about the cable such that when the connector is terminated to the cable and the strain relief member is secured to the connector with the ferrule crimped about the cable, forces transmitted along the cable are transferred to the connector through the strain relief member and are thereby prevented from being transmitted to the conductor-to-contact terminations.

DESCRIPTION OF THE PREFERRED EMBODIMENT

Figure 1:
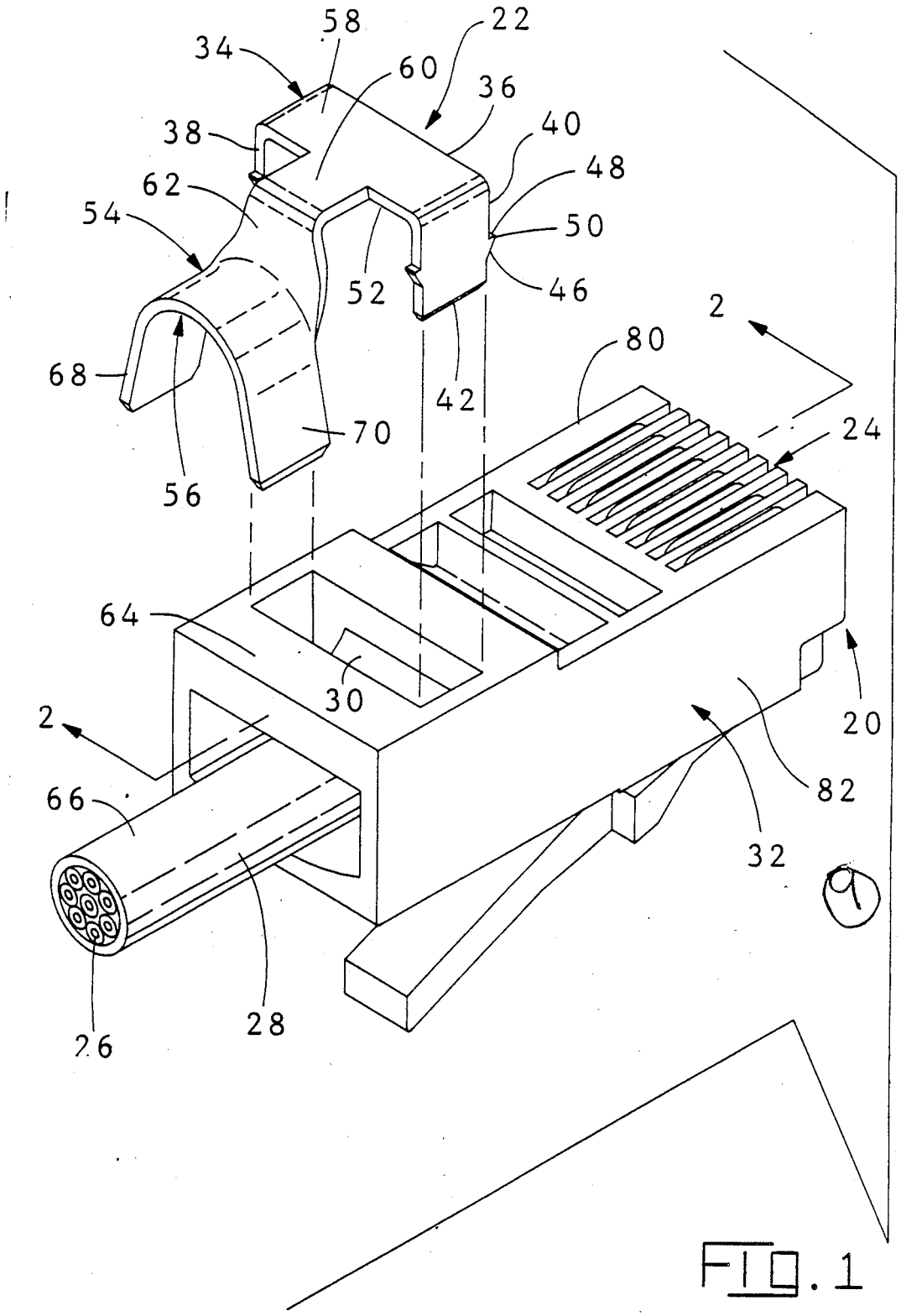
FIG. 1 is an isometric view of a connector having a secondary strain relief member, in accordance with the present invention, exploded therefrom.

An electrical connector 20 having a secondary strain relief member 22, in accordance with the present invention, exploded therefrom is shown in FIG. 1. Connector 20 as shown in the preferred embodiment is a modular telephone plug, but is not limited thereto. While connector 20 is shown as an unshielded connector, the invention may be used with shielded connectors wherein the cable shield may be commoned with either a contact in the connector or the connector shield. Contacts 24 are secured in connector 20 and are terminated to respective conductors 26 of multiple conductor cable 28.

Strain relief member 22 is positioned to be received in recess or aperture 30 of housing 32. Strain relief member 22 has a U-shaped staple portion 34. Staple portion 34 has a bight 36 and a pair of spaced legs 38,40, each integral with bight 36 at one end and extending to respective free ends 42. Each leg 38,40 has barbs 44 thereon for securing strain relief member 22 to connector 20. Barbs 44 are tapered outwardly from a respective leg forming tapered surface 46, terminating in shoulder 48 facing opposite to the direction of insertion, and defining tip 50 at the intersection thereof.

Bight 36 has extending from edge 52 an intermediate portion 54 having an insulation support ferrule 56 integral therewith. Intermediate portion 54 includes first tab 58, transition 60 and second tab 62. First tab 58 is integral with bight 36 and extends between bight 36 and transition 60, folding to form a bend as it joins transition 60. Second tab 62 is integral with insulation support ferrule 56 and extends between ferrule 56 and transition 60, folding to form a bend as it joins transition 60. Intermediate portion 54 bends around cross member 64 to permit staple portion 34 to be secured to housing 32 and insulation support ferrule 56 to be crimped to cable 28 such that forces transmitted along cable 28 are transferred to housing 32 through strain relief member 22 and are thereby prevented from being transmitted to the terminations of conductors 26 to contacts 24 in housing 32.

Figure 5:
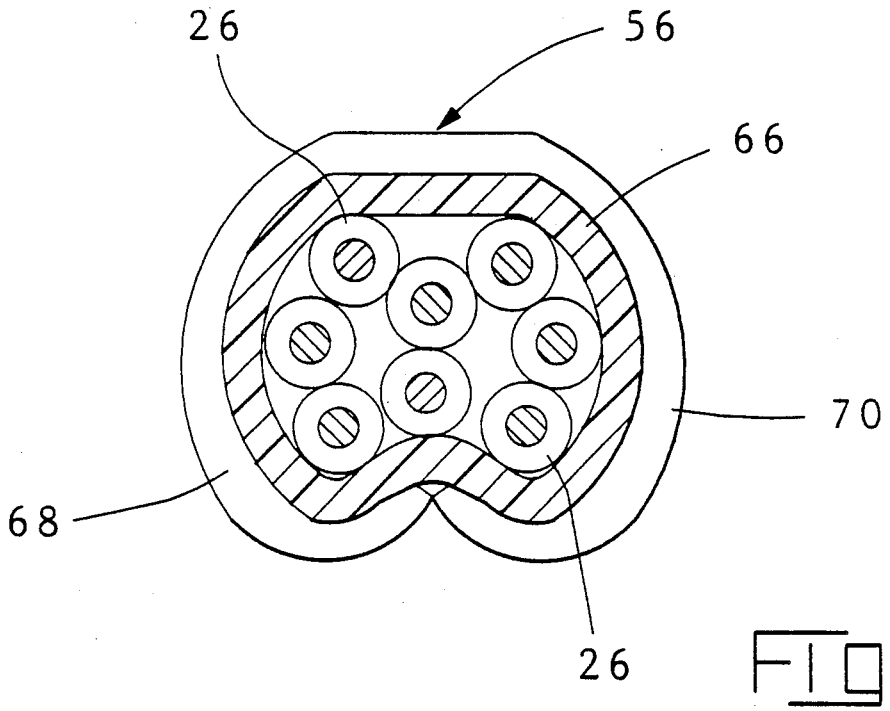
FIG. 5 is a cross section view of the cable of FIG. 4 taken adjacent the crimp.

Insulation support ferrule 56 is C-shaped, connects to second tab 62 at substantially the middle, and has cable jacket 66 gripping tines 68,70 of sufficient combined length to substantially circumscribe cable 28 when crimped therearound. Tines 68,70 are crimped around cable 28 to secure insulation support ferrule 56, and hence strain relief 22, to cable 28. Tines 68,70, when crimped as known in the art and as shown in FIG. 5, securely grip cable 28.

In the preferred embodiment, strain relief member 22 is manufactured of brass. Other materials, such as bronze or steel, may be used that are capable of transferring forces transmitted along cable 28 to connector 20 through the strain relief member 22.

Figure 2:
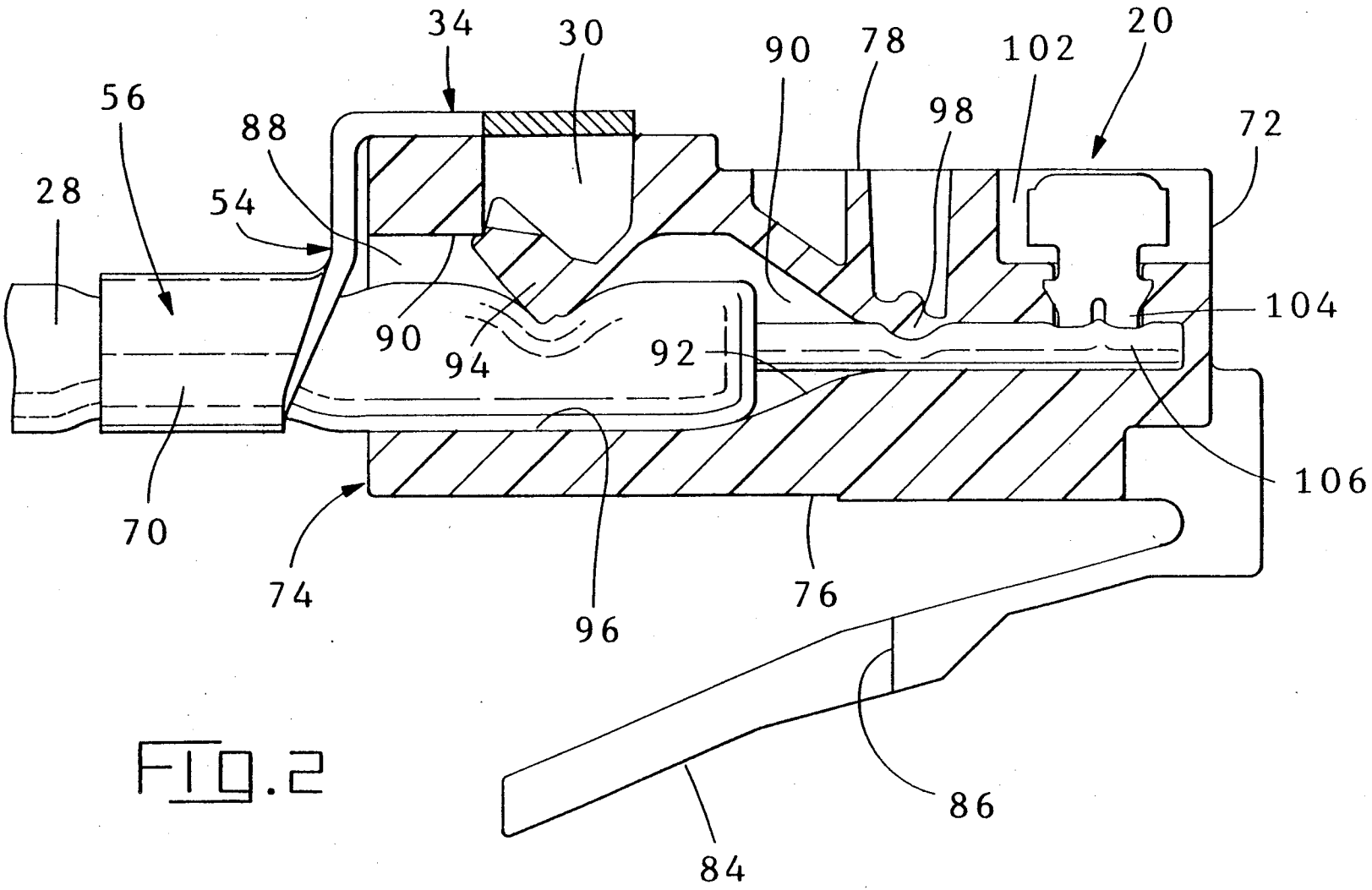
FIG. 2 is a side sectional view of the connector of FIG. 1.
Figure 3:
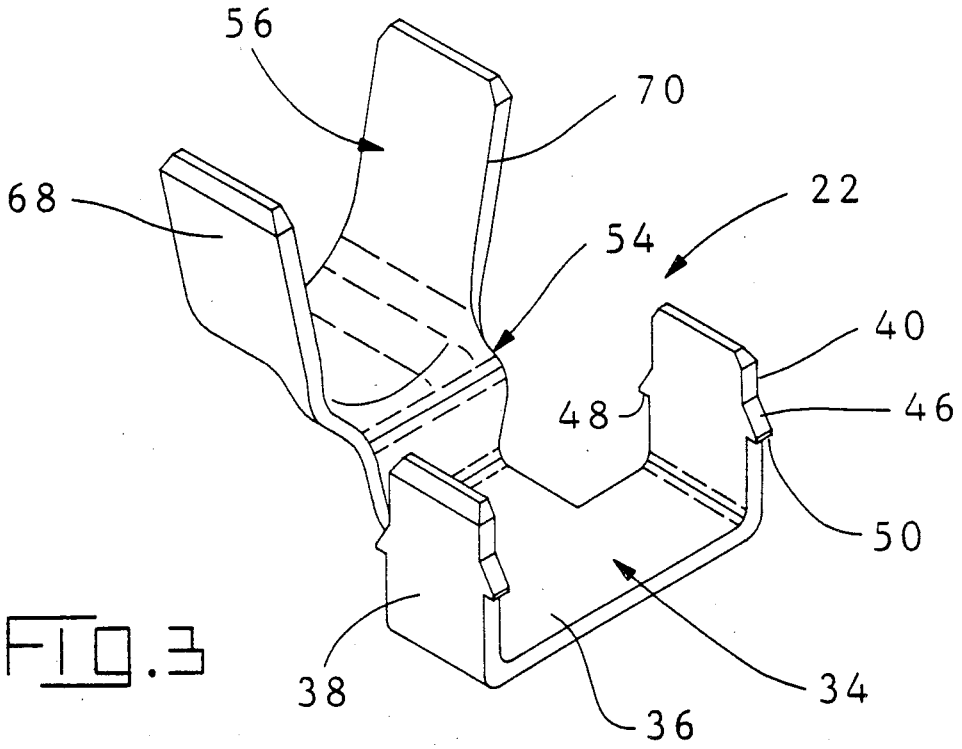
FIG. 3 is an isometric view of the secondary strain relief member of FIG. 1 from another perspective.

A side sectional view of connector 20 is shown in FIG. 2. Connector 20 has a mating end 72, a rearward end 74, upper and lower housing sidewalls 76,78 and oppositely facing housing endwalls 80,82. Latch arm 84 extends from housing side wall 76 and has rearwardly facing shoulder 86 which engages a latching surface of a mating connector (not shown).

A cable receiving opening 88 opens into a cable passage 90 that extends from rearward end 74 having cable 28 received therein. Conductors 26 of cable 28 extend into a reduced cross section forward portion 92 of passage 90 with cable 28 being retained by an integral hinged primary strain relief clamp 94 in recess 30. Clamp 94 compresses jacket 66 and hence cable 28 against the upper surface 96 of passage 90 to provide strain relief to cable 28. Conductors 26 are retained by hinged conductor strain relief means 98 in recess 100 in accordance with U.S. Pat. No. 3,860,316, the disclosure of which is hereby incorporated by reference. Contacts 24 are received in recesses 102 which extend inwardly from mating end 72 and inwardly from upper sidewall 76. Contacts 62 have insulation piercing portions 104 which extend through apertures 106 then pierce the insulation to electrically and mechanically engage a respective conductor of cable 28.

Figure 4:
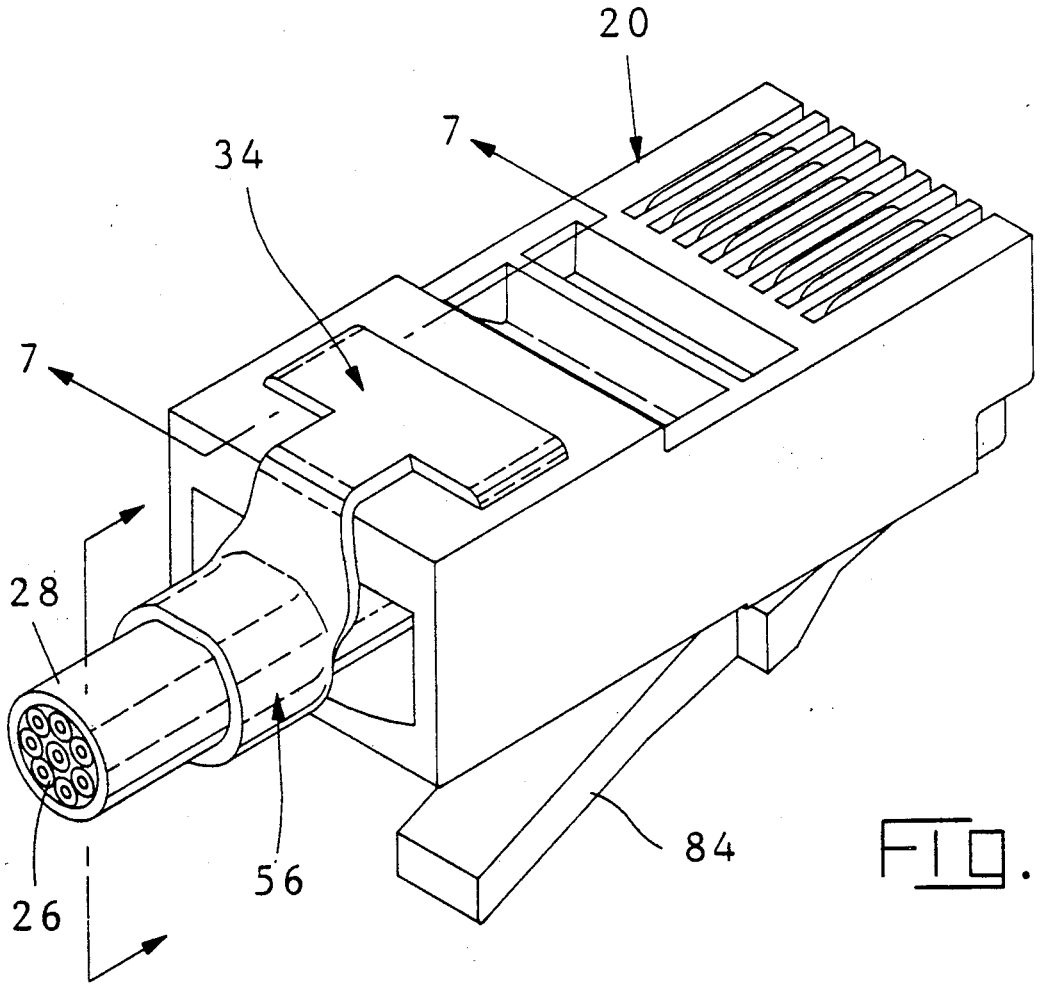
FIG. 4 is an isometric view of a connector terminated to a cable, having a secondary strain relief member providing supplemental strain relief therebetween.

A strain relief member 22 secured to a connector 20 and to a cable 28 is shown in FIG. 4. Insulation support ferrule 56 is shown crimped with tines 68,70 formed to substantially circumscribe jacket 66 to secure strain relief member 22 to cable 28. A cross section of cable 28 adjacent the ferrule 56 is shown in FIG. 5. Staple portion 34 is secured to connector 20 as described below with respect to FIGS. 6 through 8. Forces on cable 28, such as axial forces along cable 28 tugging on the cable while connector 20 is mated and latched to a complimentary connector, are transmitted from cable 28 through strain relief member 22 to housing 32 thereby preserving the integrity of respective terminations between insulation piercing portions 104 and conductors 26.

Figure 6:
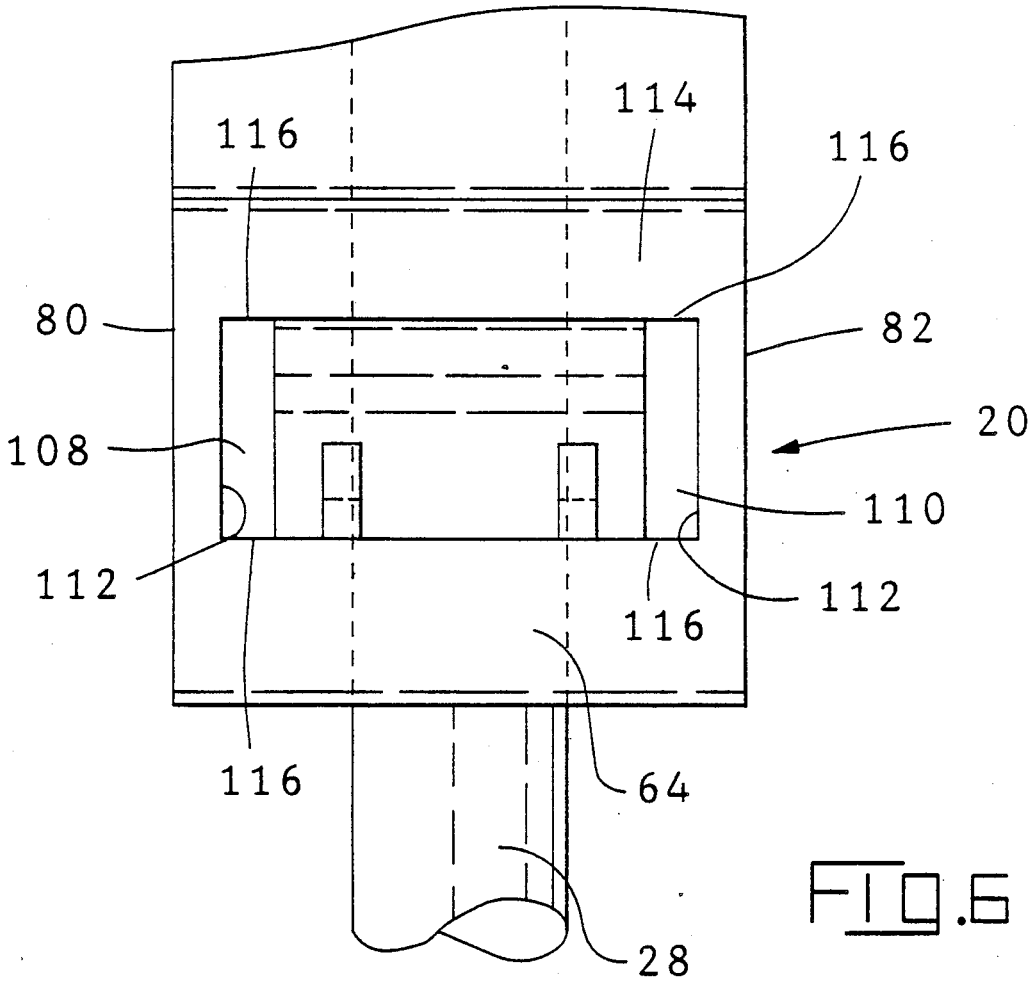
FIG. 6 is a partial top view of a connector.

As best seen in FIG. 6, primary strain relief clamp 94 does not extend the full width of recess 30, leaving gaps 108,110 at the ends thereof. Leg 38 of strain relief member 22 is received in gap 108 between the end of primary strain relief cap 94, inner side wall 112, rear cross number 64 and forward cross member 114. Leg 40 of strain relief member 22 is received in gap 110 between the other end of primary strain relief cap 94, inner side wall 112, rear cross number 64 and forward cross member 114. Upon insertion of staple portion 34 into recess 30, the distal end 42 of legs 38,40 enter recess 30 then gaps 108,110, respectively. Barbs 44 engage and plow through the side wall 116 of cross members 64 and 114.

Figure 7:
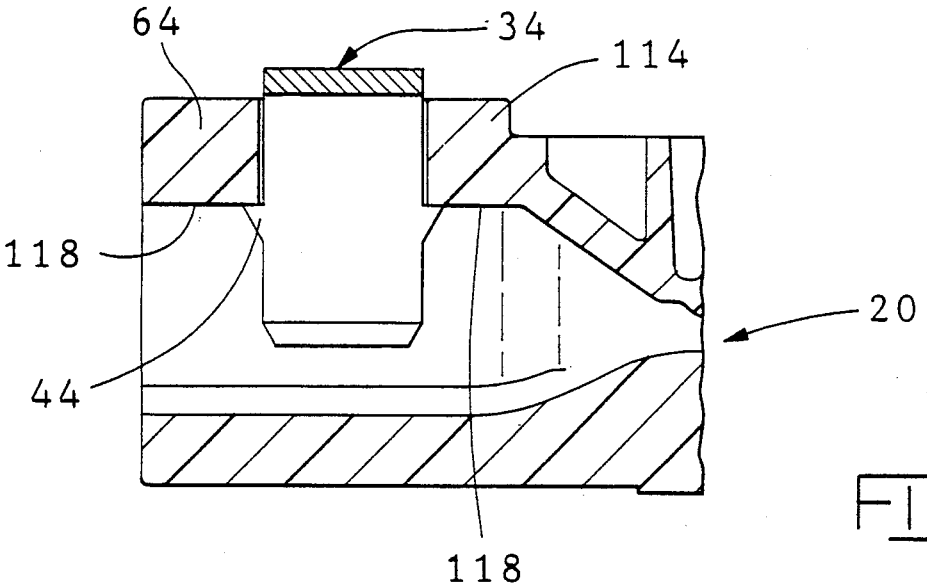
FIG. 7 is a partial side sectional view of a connector showing retention of the secondary strain relief member.

As shown in FIG. 7, legs 38,40 with barbs 44 appropriately positioned therealong are inserted to a depth such that tip 50 rides over the bottom surface 118 of cross members 64,114, with shoulder 48 positioned to engage bottom surface 118 to secure strain relief member 22 to housing 32. In this manner, legs 38,40 are received on diametrically opposite sides of cable 28, and cable 28 is received between legs 38,40. While bight 36 could engage primary strain relief clamp 94 to provide pressure thereto and enhance the strain relief function of clamp 94, in the preferred embodiment it does not.

Figure 8:
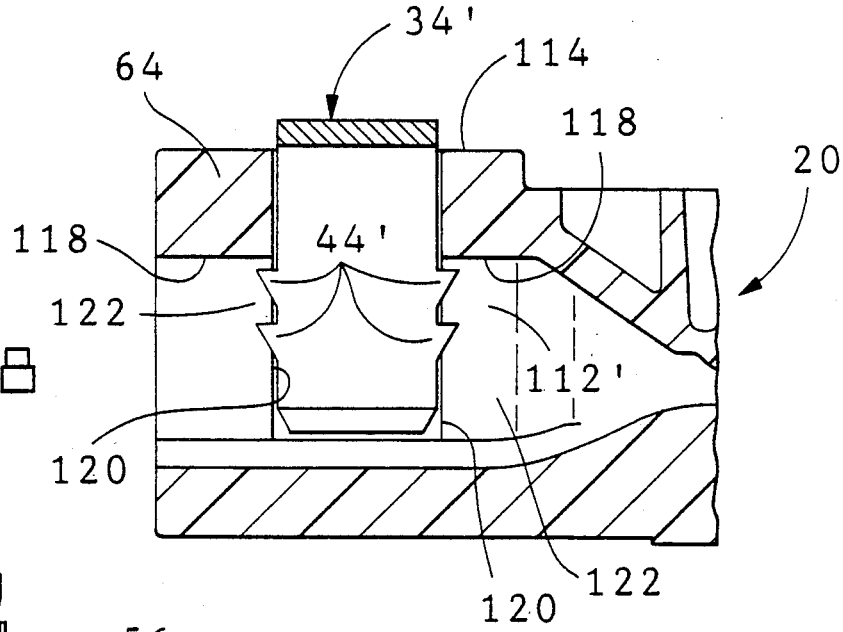
FIG. 8 is a partial side sectional view of a connector showing an alternate retention system for the secondary strain relief member.

An alternate embodiment leg retention is shown in FIG. 8 wherein barbs 34' on staple portion 34' engage wall means 120 of ribs 122 on inner side wall 112'. Barbs 44' provide an interference fit with wall means 120 that secure strain relief member 22 to connector 20. In this embodiment, barbs 44' may secure strain relief member 22 to connector 20 with or without relying on engagement of shoulder 48 with bottom surface 118. Alternatively, barbs could secure strain relief member 22 to connector 20 by engaging inner side wall 112.

Figure 9:
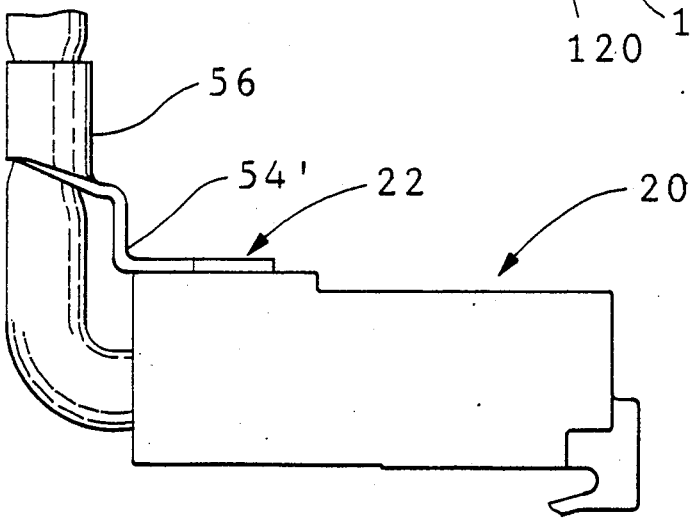
FIG. 9 shows an alternate embodiment for a 90 degree cable exit from the connector.

An alternate embodiment strain relief member 22 is shown in FIG. 9 wherein intermediate portion 54" is bent and therefore adapted to provide a 90° cable bend as cable 28 extends away from connector 20.

I claim:

1. A strain relief member adapted for securing a multiple conductor cable to a connector to provide strain relief to terminations of conductors of the multi-conductor cable to respective contacts in the connector when the strain relief member is secured to both the connector and the cable, the connector having a recess defining wall means, the strain relief comprising:

a U-shaped portion having a bight and two legs extending therefrom, said U-shaped portion is adapted to be received in the recess of the connector with said legs adapted to pass beside the cable with the cable received between said legs, said legs having securing means thereon adapted to secure said strain relief member to the connector, said bight having extending therefrom an insulation support ferrule adapted to be crimped about the cable, whereby when the connector is terminated to the cable and the strain relief member is secured to the connector with the ferrule crimped about the cable, forces transmitted along with the cable are transferred to the connector through the strain relief member and are thereby prevented from being transmitted to the conductor to contact terminations.

2. A strain relief member as recited in claim 1, wherein the securing means comprise barbs, said barbs tapering outwardly from said legs, said barbs terminating in a shoulder facing opposite to the direction of insertion, said shoulder adapted to engage the wall means to secure the strain relief member to the connector.

3. An electrical connector adapted to be terminated to conductors of a multi-conductor cable, comprising:

a dielectric housing having contacts secured therein, said contacts adapted to be terminated to respective conductors of the multiple conductor cable;

a strain relief member, said strain relief member having a U-shaped portion having a bight and two legs extending therefrom, said U-shaped portion has legs adapted to pass beside the cable with the cable received between said legs, said legs having securing means thereon adapted to secure said strain relief member to said housing, said bight having extending therefrom an insulation support ferrule adapted to be crimped about the cable, whereby when the connector is terminated to the cable and the strain relief member is secured to the connector with the ferrule crimped about the cable, forces transmitted along the cable are transferred to the housing through the strain relief member and are thereby prevented from being transmitted to the conductor-to-contact terminations.

4. An electrical connector as recited in claim 3, wherein the securing means comprise barbs, said barbs tapering outwardly from said legs, said barbs terminating in a shoulder facing opposite to the direction of insertion, said shoulder engaging the housing to secure the strain relief member to the housing.

5. An electrical connector adapted to be terminated to conductors of a multi-conductor cable, comprising:

a dielectric housing having contacts secured therein, said contacts adapted to be terminated to respective conductors of the multiple conductor cable, said housing having a primary strain relief means for engaging the cable when terminated to the connector and compressing the cable against a wall of the connector;

a secondary strain relief member, said secondary strain relief member having a U-shaped portion having a bight and two legs extending therefrom, said legs having securing means thereon adapted to secure said secondary strain relief member to said housing, said bight having extending therefrom an insulation support ferrule adapted to be crimped about the cable, whereby when the connector is terminated to the cable the primary strain relief means provides strain relief to the cable and the secondary strain relief member is secured to the connector with the ferrule crimped about the cable, forces transmitted along the cable are transferred to the housing through the secondary strain relief member and are thereby further prevented from being transmitted to the conductor-to-contact terminations.

6. An electrical connector as recited in claim 5, wherein the securing means comprise barbs, said barbs tapering outwardly from said legs, said barbs terminating in a shoulder facing opposite to the direction of insertion, said shoulder engaging the housing to secure the strain relief member to the housing.

7. An electrical connector as recited in claim 6, wherein said U-shaped portion has legs adapted to pass beside the cable with the cable received between said legs.

* * * * *